US006702431B1

(12) United States Patent
Hosono

(10) Patent No.: US 6,702,431 B1
(45) Date of Patent: Mar. 9, 2004

(54) INK JET RECORDING HEAD AND IMAGE RECORDING APPARATUS INCORPORATING THE SAME

(75) Inventor: Satoru Hosono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/493,090

(22) Filed: Jan. 28, 2000

(30) Foreign Application Priority Data

Jan. 29, 1999 (JP) ..... 11-023308

(51) Int. Cl.[7] ..... B41J 2/045

(52) U.S. Cl. ..... 347/70; 347/68; 347/69; 347/71

(58) Field of Search ..... 347/70, 71, 69, 347/68

(56) References Cited

U.S. PATENT DOCUMENTS

| | | | | |
|---|---|---|---|---|
| 4,525,728 A | * | 6/1985 | Koto | 347/70 |
| 5,471,232 A | * | 11/1995 | Hosono et al. | 347/70 |
| 6,213,594 B1 | * | 4/2001 | Kitahara | 347/70 |
| 6,231,169 B1 | * | 5/2001 | Yazaki et al. | 347/70 |

FOREIGN PATENT DOCUMENTS

| | | | | |
|---|---|---|---|---|
| EP | 0573055 | * | 8/1993 | |
| EP | 0 573 055 A2 | | 12/1993 | B41J/2/14 |
| EP | 0 678 387 A2 | | 10/1995 | B41J/2/14 |
| EP | 0 728 583 A2 | | 8/1996 | B41J/2/045 |
| EP | 0 775 579 A2 | | 5/1997 | B41J/2/14 |
| EP | 0 787 589 A2 | | 8/1997 | B41J/2/045 |
| EP | 0 893 259 A2 | | 1/1999 | B41J/2/045 |
| JP | 57-91275 | | 6/1982 | B41J/3/04 |
| JP | 58-5269 | | 1/1983 | B41J/3/04 |
| JP | 58-5270 | | 1/1983 | B41J/3/04 |
| JP | 58-5271 | | 1/1983 | B41J/3/04 |
| JP | 58-5272 | | 1/1983 | B41J/3/04 |
| JP | 58-187365 A | | 11/1983 | |
| JP | 61-141566 | | 6/1986 | B41J/3/04 |
| JP | 36314915 | * | 6/1988 | |
| JP | 4-1052 | | 1/1992 | B41J/2/045 |
| JP | 4-36071 | | 2/1992 | F03B/3/04 |
| JP | 4-64449 | | 2/1992 | B41J/2/045 |
| JP | 6-328689 A | | 11/1994 | |
| JP | 7-314668 A | | 12/1995 | |
| JP | 8-150716 A | | 6/1996 | |
| JP | 10-34921 A | | 2/1998 | |

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

Of the compliance component of a recording head, the volume of a pressure generating chamber is set so that the percentage of the compliance of ink in the pressure generating chamber becomes larger than the percentage of the compliance of pressure generating chamber components such as a partition wall and a vibration plate making up the pressure generating chamber. Accordingly, it possible to decrease variations in the compliance of the recording head without depending only on the accuracy of finishing.

24 Claims, 5 Drawing Sheets

INK JET RECORDING HEAD AND IMAGE RECORDING APPARATUS INCORPORATING THE SAME

BACKGROUND OF THE INVENTION

The present invention relates to an ink jet recording head used with an ink jet printer, or the like.

In an ink jet recording head in a related art, for example, in an ink jet recording head using a piezoelectric vibrator as an electromechanical transducing element, a channel formation substrate and a vibration plate are laminated on a nozzle plate with a plurality of nozzle orifices arranged in rows, forming a channel unit, which is joined to a case.

That is, the channel formation substrate is formed with pressure generating chambers like through holes communicating with the nozzle orifices, a common ink reservoir for storing ink supplied to the pressure generating chambers, ink supply ports through which the common ink reservoir and the pressure generating chambers communicate with each other, and the like, the members being defined by partition walls. The vibration plate consists of a thick portion (island portion) and a thin portion (film portion) surrounding the thick portion. Specifically, a composite plate comprising a resin film 3 to 10 $\mu$m thick and a stainless plate 20 to 50 $\mu$m thick is etched, forming the island portion with a stainless portion left and the film portion.

A nozzle plate is bonded to one side of the channel formation substrate and the vibration plate is bonded to an opposite side, thereby forming the channel unit. Piezoelectric vibrators are placed corresponding to the pressure generating chambers and are fixed to the case and the channel unit is attached to the case, whereby the piezoelectric vibrators are abutted against predetermined portions (island portions) of the vibration plate of the pressure generating chambers corresponding to the piezoelectric vibrators and are fixed.

With the described recording head, ink is supplied from the common ink reservoir to each pressure generating chamber and the vibration plate is bent by the action of the piezoelectric vibrator for pressurizing the pressure generating chamber, so that an ink drop is jetted through the nozzle orifice by the pressure.

For this kind of recording head, in recent years, an extremely high resolution, such as 720 dpi or 1440 dpi, has been demanded; moreover, a high resolution has been demanded using four color inks of black, yellow, magenta, and cyan. Thus, it becomes necessary to jet ink drops made small with several ng per dot and therefore the characteristic vibration frequency of ink in the pressure generating chamber must be raised.

However, if an attempt is made to raise the characteristic vibration frequency, the characteristic vibration frequency f varies largely depending on compliance (easy-to-deform property; represented by a unit of [$m^3$/Pa]) of the recording head. The relation between f and C is represented by the following equation:

$$f = \frac{1}{2\pi\sqrt{MC}}$$

here, M denotes inertance of the mass of a medium per unit length (described later). Therefore, tolerance variation at the manufacturing stage seriously affects the jet characteristic of the recording head.

That is, very high accuracy of finishing in $\mu$m units is required when cavities of the pressure generating chambers, the ink supply ports, etc., of the channel formation substrate are formed or the vibration plate is formed with the island portion.

However, when the island and film portions are formed by etching metal, variations of ±20 $\mu$m in the longitudinal direction of the island portion and ±7 $\mu$m in the widthwise direction occur and the compliance C varies due to area variations in the film portion.

The component of the compliance C of the recording head can be roughly classified into compliance C.ink of ink in the pressure generating chambers and compliance C.str of pressure generating chamber components such as the partition walls, the vibration plate, and the nozzle plate forming the pressure generating chambers.

C.ink is proportional to the pressure generating chamber volume which depends mainly on the accuracy of finishing of the channel formation substrate. Specifically, required accuracy can be provided by applying an anisotropic etching technique of silicon.

However, in the film portion of the vibration plate (portion where C.str makes up the greatest percentage), it is hard to lessen the variations in the compliance caused by tolerance variations as described above.

In the recording head in the related art, the ink compliance C.ink makes up 20% to 45% of the compliance of the whole head, compliance C.cav of the partition walls and nozzle plates of the pressure generating chambers makes up 2%, and compliance C.film of the vibration plate makes up 53% to 78%; the compliance C.str of the pressure generating chamber components (C.cav+C.film) makes up about 50% to 80%.

Thus, if the recording head is made up of the vibration plate, the channel formation substrate, etc., worked under the tolerance as described above, it is not easy to place the compliance for each assembled recording head in a predetermined range; particularly, the recording head compliance largely varies depending on how the vibration plate is worked.

The recording head with the compliance C.str of the pressure generating chamber components out of a predetermined range becomes a defective piece. Therefore, yield lowers if an attempt is made to raise the characteristic vibration frequency of ink in the pressure generating chamber for providing a high resolution as mentioned above.

SUMMARY OF THE INVENTION

It is therefore an object of the invention to provide an ink jet recording head for making it possible to decrease variations in the compliance of the recording head without depending only on accuracy of finishing and suppress occurrence of recording heads which become defective pieces for improving yield.

In order to achieve the above object, there is provided an ink jet recording head comprising:

- an electromechanical transducing element;
- a nozzle plate provided with a plurality of nozzle orifices;
- a channel forming substrate including:
  - partition walls defining a plurality of pressure generating chambers arranged so as to correspond to the nozzle orifices; and
  - ink supply ports for supplying ink into associated pressure generating chambers;
- a vibration plate composing a part of an inner wall of the respective pressure generating chambers for being flexed by deformation of the electromechanical transducing element to varying the volume of the respective pressure generating chambers; and a compliance component including:

a first compliance component comprising at least one member composing the respective pressure generating chambers; and a second compliance component comprising the ink in the respective pressure generating chambers, and being larger than the first compliance component.

For example, the first compliance component may include the partition walls and the vibrating plate.

Specifically, the second compliance component accounts for more than 45% of the compliance component.

Accordingly, the percentage of the compliance varying depending on the accuracy of finishing of the channel formation substrate and the vibration plate lessens relatively. Therefore, if the parts are worked under the tolerance in the related art, the compliance of the recording head is less affected. Thus, the compliance for each manufactured recording head easily enters a predetermined range, so that occurrence of defective pieces can be suppressed for improving yield.

In order to increase the relative percentage of the second compliance component, the volume of the respective pressure generating chamber is increased.

Accordingly, the compliance of the recording head can be stabilized without making the accuracy of finishing specially strict.

In order to increase the volume of the respective pressure generating chambers, thickness of the channel forming substrate is thickened.

Accordingly, if a silicon wafer is used to form the channel formation substrate, rapid cost increase can be avoided and miniaturization of the recording head can be maintained.

In order to obtain the relative higher percentage of the second compliance component, thickness of the vibrating plate is thickened so as to lower a relative percentage of the first compliance component.

Accordingly, stabilization of the compliance of the recording head can be accomplished easily.

In the recording head, the vibration plate is composed of a resin film and a metal layer.

Accordingly, it is easy to relatively lower the percentage of the compliance of the vibration plate by using a thick resin film.

In the recording head, the electromechanical transducing element is a piezoelectric vibrator.

In the recording head, the pressure generating chambers and the ink supply ports are formed by etching a silicon wafer anisotropically.

Accordingly, extremely high accuracy of finishing is provided easily.

According to the present invention, there is provided an image recording apparatus comprising an ink jet recording head as described above.

In the recording head, the respective pressure generating chambers may be partitioned into a plurality of chambers in a deforming direction of the electromechanical transducing element which are communicated with each other by a through hole.

DETAILED DESCRIPTION OF THE PREFERRED EMBODIMENTS

Referring now to the accompanying drawings, there is shown an embodiment of the invention. First, an ink jet printer as an image recording apparatus to which the present invention is applied will be discussed with reference to FIGS. 4 and 5.

Figure 4:
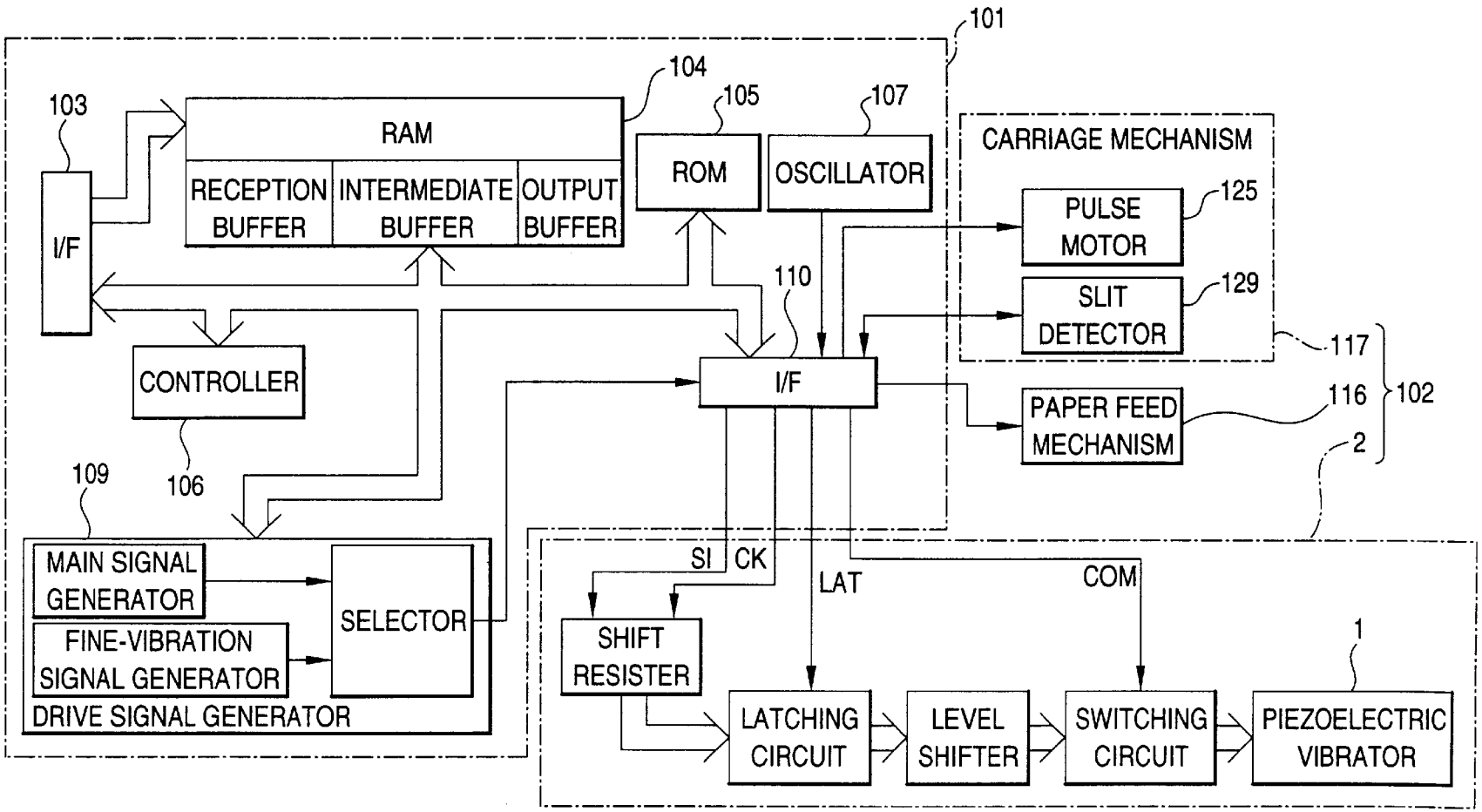
FIG. 4 is a block diagram to describe the configuration of an ink jet printer.

As shown in FIG. 4, the ink jet printer is roughly made up of a printer controller 101 and a print engine 102.

The printer controller 101 comprises an external interface 103 (external I/F 103), RAM (random access memory) 104 for temporarily storing various pieces of data, ROM (read-only memory) 105 for storing a control program, etc., a controller 106 containing a CPU (central processing unit), etc., an oscillator 107 for generating a clock signal, a drive signal generator 109 for generating a drive signal supplied to a recording head 2, and an internal interface 110 (internal I/F 110) for transmitting the drive signal and dot pattern data (bit map data) expanded based on print data and the like to the print engine 102.

The external I/F 103 receives print data made up of character code, a graphic function, image data, etc., for example, from a host computer (not shown), etc. A busy signal (BUSY) and an acknowledge signal (ACK) are output through the external I/F 103 to the host computer, etc.

The RAM 104 functions as a reception buffer, an intermediate buffer, an output buffer, and work memory (not shown). The reception buffer temporarily stores the print data received through the external I/F 103, the intermediate buffer stores intermediate code data provided by the controller 106, and the output buffer stores dot pattern data. The dot pattern data is print data provided by decoding (translating) gradation data.

The ROM 105 stores font data, graphic functions, etc., in addition to the control program (control routine) for performing various types of data processing.

The controller 106 performs various types of control. In addition, it reads the print data in the reception buffer and stores the intermediate code data provided by converting the print data in the intermediate buffer. Also, the controller 106 analyzes the intermediate code data read from the intermediate buffer, references the font data, graphic function, etc., stored in the ROM 105, and expands the intermediate code data into dot pattern data. After performing necessary decoration processing, the controller 106 stores the dot pattern data in the output buffer.

If one line of the dot pattern data that can be recorded by one main scanning of the recording head 2 is provided, it is output from the output buffer through the internal I/F 110 to the recording head 2 in sequence. When one line of the dot pattern data is output from the output buffer, the already expanded intermediate code data is erased from the intermediate buffer and the next intermediate code data is expanded.

The drive signal generator 109 comprises a main signal generator for generating a jetting drive signal used for recording, a fine-vibration signal generator for generating a non-print fine-vibration signal and a pre-print fine-vibration signal for finely vibrating a meniscus (free surface of ink exposed on nozzle orifice) for agitating ink in the nozzle orifice, and a selector, to which the jetting drive signal from the main signal generator and the out-of-print fine-vibration signal or the before-print fine-vibration signal from the fine-vibration signal generator are input, for selectively outputting the input signal to the internal I/F 110.

The print engine 102 comprises a paper feed mechanism 116, a carriage mechanism 117, and the above-mentioned recording head 2.

Figure 5A:
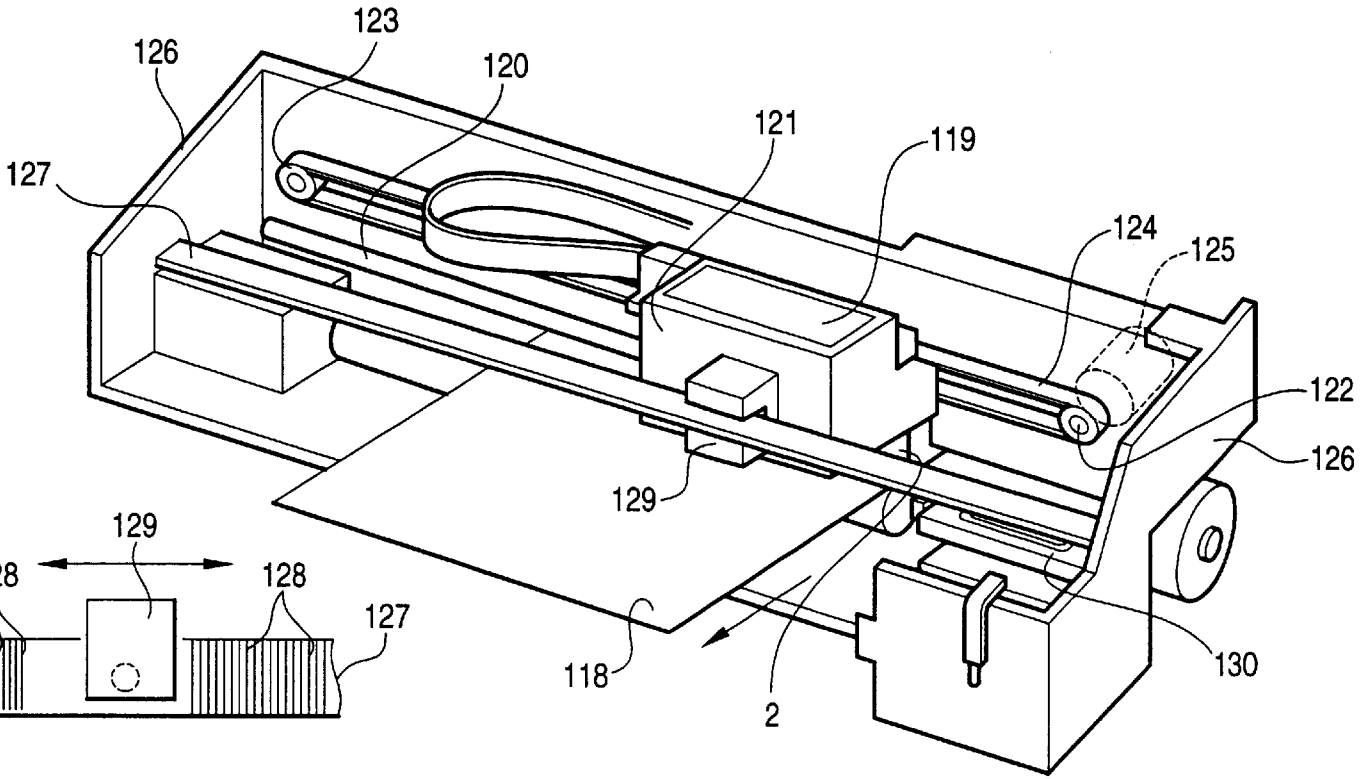
FIG. 5A is a perspective view showing the internal mechanism of the ink jet printer.

The paper feed mechanism 116 is made up of a paper feed motor, a paper feed roller, etc. As shown in FIG. 5A, it feeds record paper 118 (a kind of print record medium) in sequence in association with the record operation of the recording head 2. That is, the paper feed mechanism 116 moves the record paper 118 in the record paper feed direction, which is a subscanning direction.

The carriage mechanism 117 comprises a carriage 121 on which the recording head 2 and an ink cartridge 119 can be mounted, the carriage 121 being attached to a guide member 120 movably, a timing belt 124 placed on a drive pulley 122 and a driven pulley 123 and connected to the carriage 121, a pulse motor 125 for rotating the drive pulley 122, a linear encoder 127 placed on a printer cabinet 126 in parallel with widthwise direction of the record paper (along the main scanning direction), and a slit detector 129 attached to the carriage 121 and capable of detecting a slit 128 of the linear encoder 127.

Figure 5B:
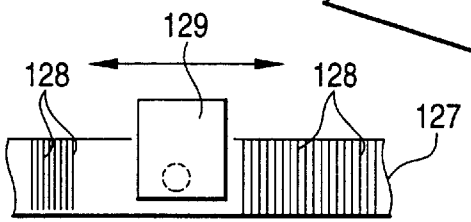
FIGS. 5B and 5C are a plan view and a sectional view showing the slit detector in the ink jet printer, respectively.
Figure 5C:
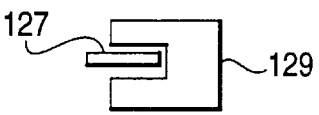

The linear encoder 127 of the embodiment is a transparent thin plate member formed with slits 128 . . . at pitches of 360 or 360/N (dpi), as shown in FIGS. 5B and 5C. The slit detector 129 is made of a photointerruptor, for example.

In the carriage mechanism 117, the carriage 121 is reciprocated along the widthwise direction of the record paper 118 by the operation of the pulse motor 125. That is, the recording head 2 mounted on the carriage 121 is moved along the main scanning direction. The carriage 121 is moved with a reference position on the home position side as the starting point. The home position is a position at which the carriage 121 is placed in a standby state if a no-power state or a no-recording state continues for many hours. In the embodiment, the right end part in FIG. 5A is the home position, where a capping mechanism 130 is provided for preventing an ink solvent from evaporating in nozzle orifice 11 (described later) of the recording head 2. The reference position is set to a left position a little from the home position. Specifically, the reference position is set where the recording head 2 is positioned between the right margin of the record paper 118 and the capping mechanism 130.

The recording head 2 is reciprocated along the main scanning direction from the reference position and ink drops are jetted from the recording head 2 in association with the reciprocation. Further, the record paper 118 is moved in the record paper feed direction, whereby any desired image can be recorded on the record paper 118.

Next, the described recording head 2 will be discussed in detail.

Figure 1:
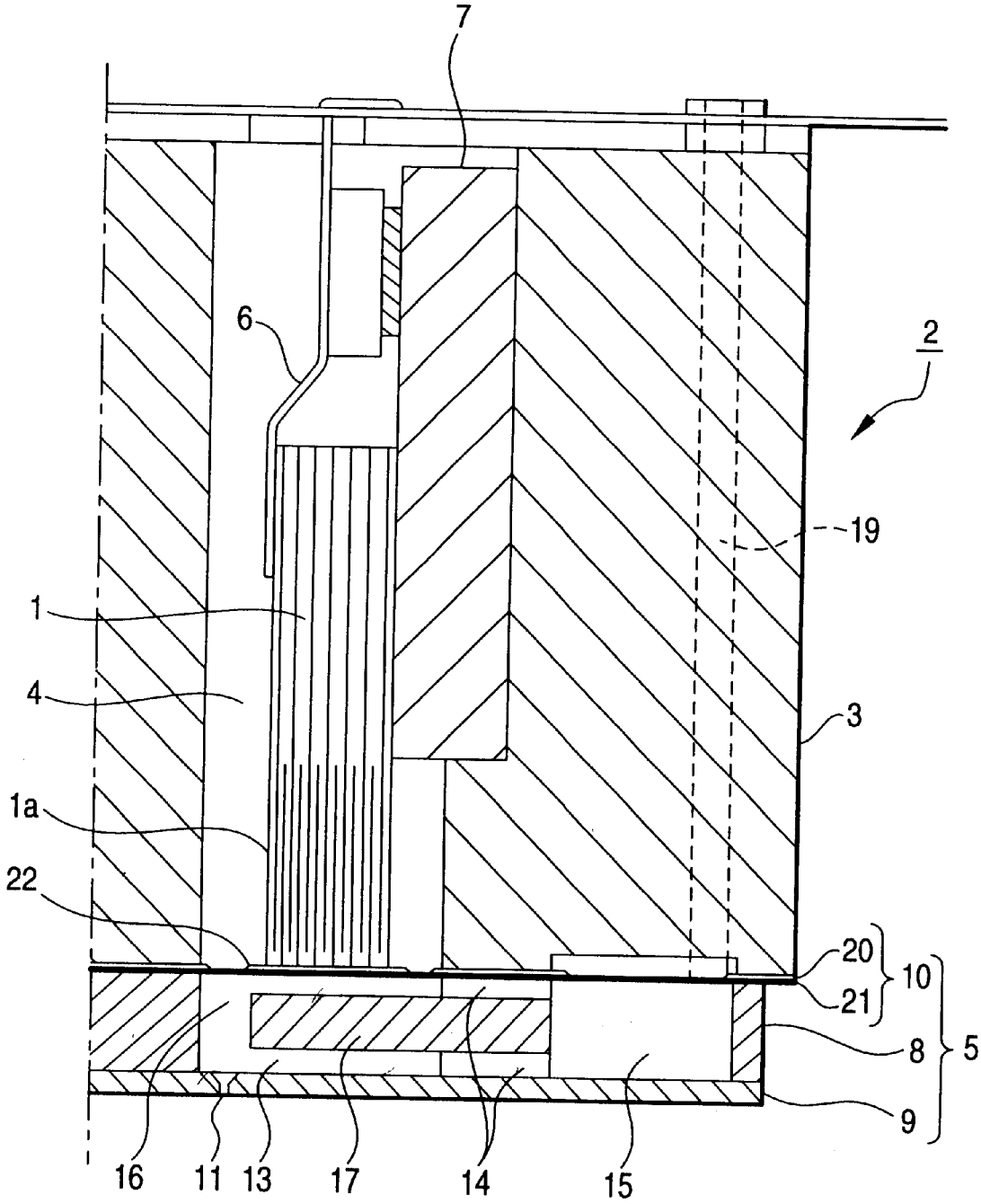
FIG. 1 is a sectional view of an ink jet recording head.
Figure 2A:
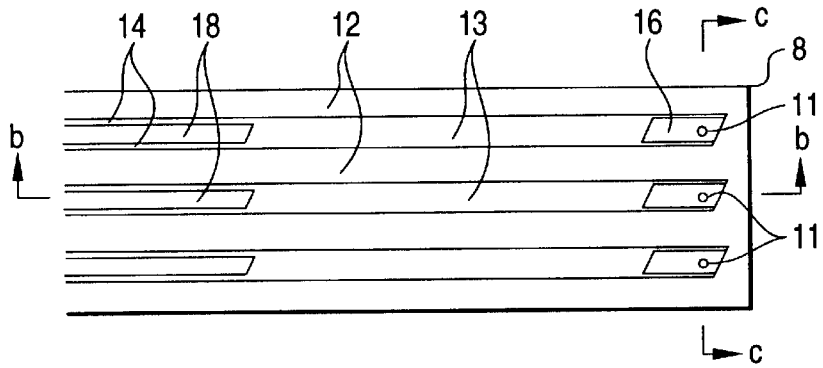
FIG. 2A is a plan view of a pressure generating chamber.
Figure 2B:
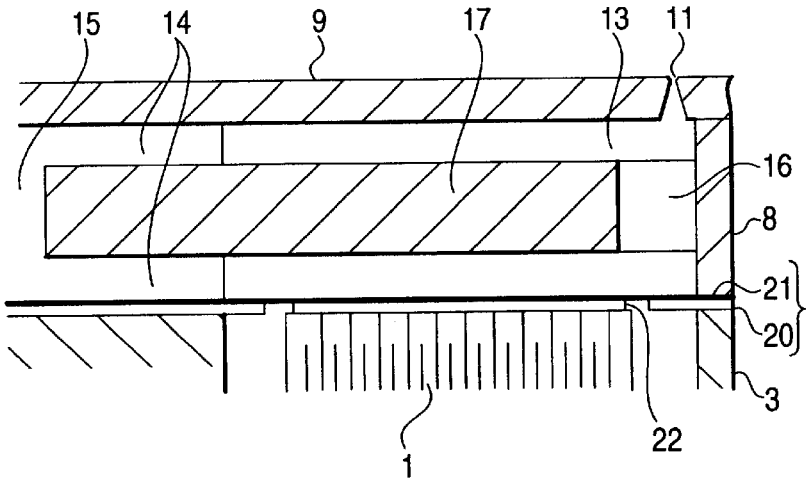
FIG. 2B is a sectional view of the recording head taken along the line b—b in FIG. 2A.
Figure 2C:
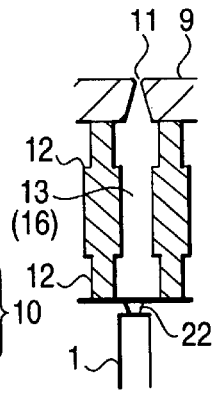
FIG. 2C is a sectional view of the recording head taken along the line c—c in FIG. 2A.

FIG. 1 is a sectional view of one embodiment of the ink jet recording head 2 using a piezoelement (PZT) of a representative piezoelectric vibrator 1 as an electromechanical transducing element. FIG. 2A is a plan view of a pressure generating chamber and FIGS. 2B and 2C are enlarged sectional views to show the main part of the recording head 2 shown in FIG. 1.

As shown in FIG. 1, to form the recording head 2, the piezoelectric vibrator 1 is inserted into a chamber 4 of a case 3 shaped like a plastic box, for example, through one opening, a tip 1*a* shaped like comb teeth is made to face an opposite opening, a channel unit 5 is joined to the surface (bottom face) of the case 3 on the opening side, and the tip 1*a* of the piezoelectric vibrator 1 is abutted against and fixed to a predetermined portion of the channel unit 5. In FIG. 1, numeral 6 denotes a flexible cable and numeral 7 denotes a fixed substrate.

The channel unit 5 comprises a nozzle plate 9 and a vibration plate 10 laminated on both sides with a channel formation substrate 8 in between.

The nozzle plate 9 is a stainless thin plate with a plurality of nozzle orifices 11 arranged in rows at pitches corresponding to the dot formation density; in the embodiment, it is formed with five rows of nozzle orifices 11 (96 nozzle orifices per row) made at the pitches of about 0.141 mm (180 dpi).

As shown in FIG. 2, the channel formation substrate 8 laminated on one face of the nozzle plate 9 is a plate-like member formed with cavities which is to be pressure generating chambers 13 corresponding to the nozzle orifices 11 in the nozzle plate 9 in a state in which the cavities are partitioned by partition walls 12, and formed with cavities which become ink supply ports 14 and a common ink reservoir 15. Each pressure generating chamber 13 is a chamber elongated in a direction orthogonal to the nozzle orifice row; a part of the pressure generating chamber 13 is formed of a through hole 16 which is roughly parallelogrammatic in cross section piercing the channel formation substrate 8 in the thickness direction thereof and the remaining part is formed of a flat concave chamber partitioned up and down by a partition wall 17 formed at the center in the thickness direction of the channel formation substrate 8.

The pressure generating chamber 13 shown in FIG. 2 is 1216 $\mu$m long and 100 $\mu$m wide on the nozzle plate 9 side and 110 $\mu$m wide on the vibration plate 10 side, the through hole 16 is 100 $\mu$m long and 80 $\mu$m wide, the partition wall 12 on the nozzle plate 9 side is 41 $\mu$m thick, the partition wall 12 on the vibration plate 10 side is 31 $\mu$m thick, and the partition wall 12 of the part of the through hole 16 is 61 $\mu$m thick. Numeral 18 denotes a gate formed in the channel from the common ink reservoir 15 to the pressure generating chamber 13 and the gate 18 forms an ink supply passage 14 in the form of a narrow part having a narrow channel width.

The through hole 16, the pressure generating chamber 13, the ink supply port 14, and the common ink reservoir 15 of the channel formation substrate 8 are formed for each nozzle orifice 11 by etching a silicon wafer. In the embodiment, the channel formation substrate 8 is made thick, whereby the volume of each pressure generating chamber 13 is increased, whereby the percentage of the compliance of ink in the pressure generating chamber 13 (described later) is made large.

In the embodiment, the through hole 16 is made at one end of the pressure generating chamber 13, namely, at the furthermost portion from the common ink reservoir 15 in the pressure generating chamber 13. The ink supply port 14 is connected to an opposite end of the pressure generating chamber 13 and the nozzle orifice 11 is formed in the proximity of the end part on the opposite side to the ink supply port 14. In the embodiment, the nozzle orifice 11 is positioned almost at the center of the through hole 16.

The common ink reservoir 15 is a chamber for supplying ink stored in an ink cartridge (not shown) to each pressure generating chamber 13, and an ink supply tube 19 communicates almost at the center in the longitudinal direction.

In the embodiment, the vibration plate 10 serves as both a seal plate being laminated on an opposite face of the channel formation substrate 8 positioned on the opposite side to the nozzle plate 9 for sealing one opening face of the pressure generating chamber 13 and an elastic film (thin film portion) being laminated on the opposite face of the channel formation substrate 8 for sealing one opening face of the common ink reservoir 15 and is of a double structure comprising a polymer film 21 of PPS, etc., laminated on a stainless plate 20. Since both the seal plate and the elastic film are formed of the same member, the stainless plate 20 of the portion functioning as the seal member, namely, the portion corresponding to the pressure generating chamber 13 is etched to form a thick portion (island portion 22) for abutting and fixing the tip of the piezoelectric vibrator 1, and the stainless plate 20 of the portion functioning as the elastic film, namely, the portion corresponding to the common ink reservoir 15 is removed by etching for leaving only film portion 21 (elastic film).

In the embodiment, the film portion 21 of the vibration plate 10 is made thick, whereby the percentage of the compliance of the vibration plate 10 is relatively lowered and the percentage of the compliance of ink in the pressure generating chamber 13 is relatively raised. Specifically, formerly a polymeric film of PPS (polyphenylene sulfide), polyimide, etc., 3.5 $\mu$m thick was used as film portion 21; in the embodiment, the film 6 $\mu$m thick (twice as thick as the former film) is used.

In the described recording head 2, the piezoelectric vibrator 1 is expanded in the longitudinal direction of the vibrator whereby the island portion 22 is pressed against the nozzle plate 9, the film portion (elastic film) 21 surrounding the island portion 22 becomes deformed, and the pressure generating chamber 13 is contracted. If the piezoelectric vibrator 1 is contracted in the longitudinal direction of the vibrator, the pressure generating chamber 13 is expanded due to elasticity of the film portion 21. Expansion and contraction of the pressure generating chamber 13 are controlled, whereby an ink drop is jetted through the nozzle orifice 11.

Figure 3:
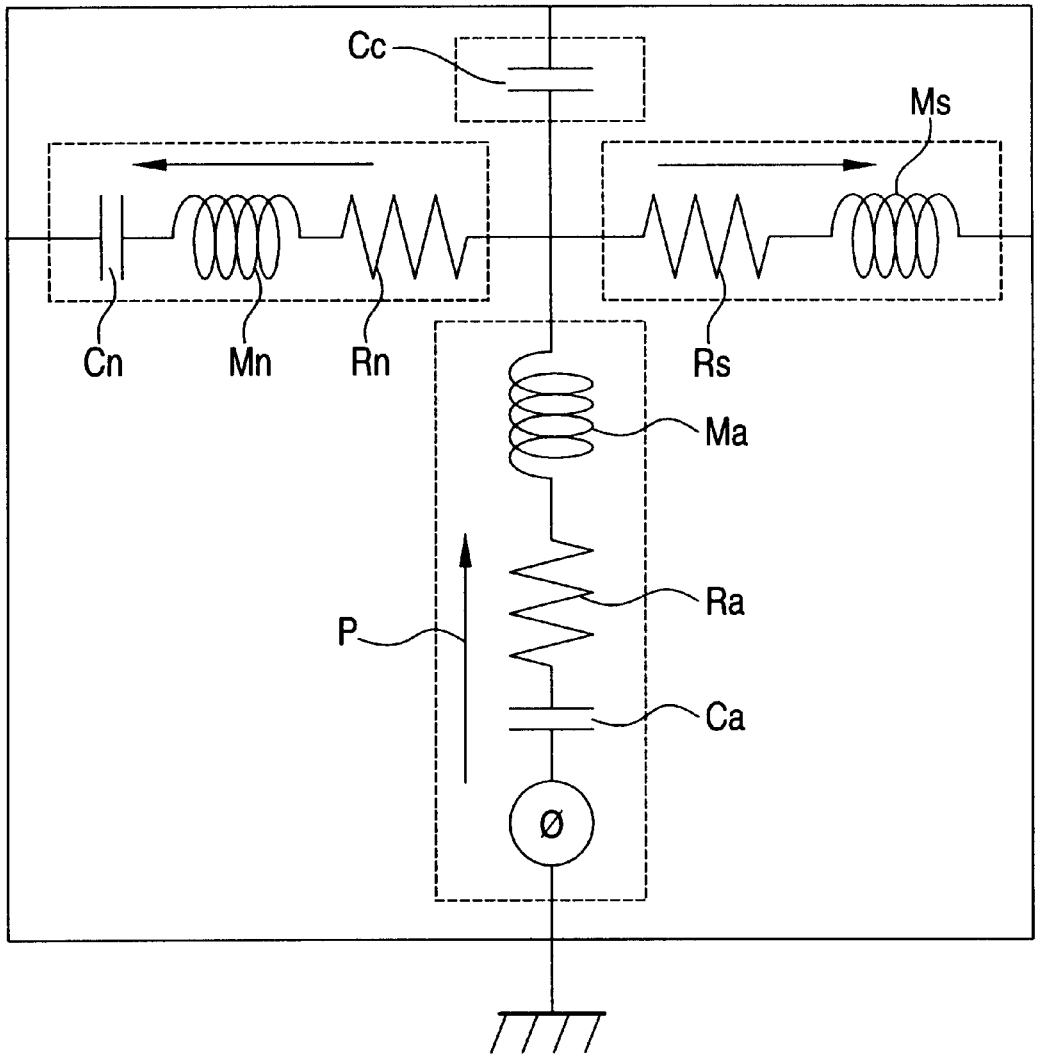
FIG. 3 is a schematic diagram representing a vibration system in the recording head by an equivalent circuit.

A vibration system in the recording head 2 can be represented by an equivalent circuit shown in FIG. 3. Here, symbol M denotes inertance of the mass of a medium per unit length [Kg/m$^4$], symbol Ma denotes inertance in the piezoelectric vibrator 1, symbol Mn denotes inertance in the nozzle orifice 11, nd symbol Ms denotes inertance in the ink supply port 14. Symbol R denotes resistance of the internal loss of a medium [N·s/m$^5$], symbol Rn denotes resistance in the nozzle orifice 11, and symbol Rs denotes resistance in the ink supply port 14. Symbol C denotes compliance of volume change per unit pressure [m$^5$/N], symbol Cc denotes compliance of the vibration plate 10 and the partition wall 12 forming the pressure generating chamber 13, symbol Ca denotes compliance in the piezoelectric vibrator 1, and symbol Cn denotes compliance in the nozzle plate 9. Symbol P denotes pressure generated with time by the piezoelectric vibrator 1, in other words, equivalent pressure into which voltage pulses applied to the piezoelectric vibrator 1 are converted.

The compliance of ink in the pressure generating chamber 13, C.ink, can be represented as in the following expression (1):

$$C.ink = \frac{V}{\rho c^2} \tag{1}$$

where V is the volume [m$^3$] of the pressure generating chamber 13, ρ is the ink density [Kgf/m$^3$], and c is the velocity [m/s] of sound in liquid.

Here, ρ and c are constant and thus C.ink can be represented as:

$$C.\text{ink}=kV\ (k\text{: constant}) \tag{2}$$

Therefore, variations in C.ink are mainly caused by the volume of the pressure generating chamber 13. Variations in the volume of the pressure generating chamber 13 depend on the accuracy of finishing of the channel formation substrate 8, but extremely high accuracy can be easily provided by applying an anisotropic etching technique of silicon.

The compliance of the pressure generating chamber 13 relates to each compliance of the nozzle plate 9, the vibration plate 10, and the partition wall 12 of the channel formation substrate 8 forming the pressure generating chamber 13, namely, functioning as the inner wall face of the pressure generating chamber 13. Letting the compliance of the pressure generating chamber components be C.str, this C.str is volume change ΔV relative to pressure change ΔP and can be represented as in the following expression (3):

$$C.str = \frac{\Delta V}{\Delta P} \tag{3}$$

As described above, almost all of C.str depends on compliance C.film of the film portion of the vibration plate 10. C.film is proportional to the cube of the thickness of the film portion 21 and proportional to the fifth power of the width, thus variations in C.str are made large with respect to shape variations.

If, of the compliance component of the recording head 2, the percentage of the compliance C.ink of ink in the pressure generating chamber 13 is made larger than the percentage of the compliance C.str of the pressure generating chamber components such as the partition wall 12 and the vibration plate 10 forming the pressure generating chamber (C.ink>C.str), the compliance of the recording head becomes hard to be affected by the accuracy of finishing of the pressure generating chamber components such as the partition wall 12 of the channel formation substrate 8 and the vibration plate 10, particularly the work state of the island portion 22 of the vibration plate 10 and an error of the thickness of the film portion 21. In other words, increasing relatively the percentage depending on the compliance of ink in the pressure generating chamber 13 out of the factors determining the compliance of the recording head 2, the percentage depending on the accuracy of finishing of the vibration plate 10 of the recording head 2 is relatively lowered, whereby variations in the compliance of the recording head 2 can be lessened.

To increase the compliance of ink in the pressure generating chamber 13, the volume of the pressure generating chamber 13 may be increased as seen from expression (2).

Specifically, in the embodiment, as described above, the silicon wafer of the channel formation substrate 8 is made thick, whereby the volume in the pressure generating chamber 13 is increased about 40% to 80%, so that the percentage of the compliance of ink in the pressure generating chamber 13 is raised.

To increase the volume in the pressure generating chamber 13, the length in the longitudinal direction may be extended; however, it is desirable to thicken the silicon wafer of the channel formation substrate 8 considering miniaturization of the recording head 2 and the silicon wafer yield.

As described above, in the embodiment, the vibration plate 10 is made thick and thus the compliance of the vibration plate 10 becomes smaller than that in the related art, so that the compliance C.str of the pressure generating chamber components decreases, the percentage of the ink compliance C.ink in the pressure generating chamber 13 is still more raised, and variations in the compliance of the recording head 2 can be still more lessened.

Since the compliance of the vibration plate 10 accounts for most of the compliance C.str of the pressure generating chamber components, it is important to thicken the vibration plate 10 to relatively decrease the percentage of the compliance C.str of the pressure generating chamber components.

Thus, in the recording head 2 shown in the embodiment, the volume in the pressure generating chamber 13 is increased and the vibration plate 10 is thickened, whereby the compliance C.film of the vibration plate 10 becomes 29%, the compliance C.cav of the pressure generating chamber 13 of the partition wall 12, etc., becomes 2%, and the ink compliance C.ink in the pressure generating chamber 13 becomes 69%; the compliance C.str of the pressure generating chamber components becomes 31%. Therefore, the relation of C.ink>C.str is satisfied and when the recording head 2 is assembled, compliance can be easily stabilized. Thus, it contributes greatly to improvement in yield.

The scope of the invention is not limited to the dimensions mentioned in the embodiment and the relation of C.ink>C.str needs only to be true. In the embodiment, the piezoelectric vibrator 1 formed of the vibrator like comb teeth in so-called vertical vibration mode comprising the piezoelectric body and internal electrode laminated in the direction orthogonal to the expansion and contraction direction of the vibrator is taken as an example. However, the invention can also be applied to a piezoelectric vibrator 1 in so-called deflection vibration mode comprising the piezoelectric body and internal electrode laminated in the expansion and contraction direction of the vibrator. Further, the electromechanical transducing element is not limited to the piezoelectric vibrator and may be an element which produces mechanical deformation as a drive signal is applied.

What is claimed is:

1. A system containing an ink jet recording head and ink, the system comprising:

ink;

an ink jet recording head, wherein the ink jet recording head further comprising:

a channel forming substrate formed with partition walls defining at least one pressure generating chamber therein;

at least one electromechanical transducing element associated with each pressure generating chamber;

a nozzle plate composing a part of an inner wall of the at least one pressure generating chamber; the nozzle plate formed with at least one nozzle orifice communicated with each associated pressure generating chamber;

a vibration plate composing a part of an inner wall of the at least one pressure generating chamber for being flexed by deformation of the electromechanical transducing element to varying the volume of the associated pressure generating chamber;

wherein compliance components of the system comprise:

a first compliance component composed of a compliance component of the partition walls of the channel forming substrate, a compliance component of the nozzle plate and a compliance component of the vibration plate, the compliance component of the vibration plate being larger than each of the compliance component of the partition walls and the compliance component of the nozzle plate; and a second compliance component corresponding to the ink contained in the at least one pressure generating chamber, the second compliance component being larger than the first compliance component.

2. The system as set forth in claim 1, wherein the volume of the at least one of the pressure generating chambers is determined so as to increase the relative percentage of the second compliance component.

3. The system as set forth in claim 2, wherein thickness of the channel forming substrate is thickened so as to increase the volume of the at least one of the pressure generating chambers.

4. The system as set forth in claim 1, wherein thickness of the vibrating plate is thickened so as to lower a relative percentage of the first compliance component to obtain the bid relative higher percentage of the second compliance component.

5. The system as set forth in claim 1, wherein the electromechanical transducing element is a piezoelectric vibrator.

6. The system as set forth in claim 1, wherein the pressure generating chambers and the ink supply ports are formed by etching a silicon wafer anisotropically.

7. The system as set forth in claim 4, wherein the vibration plate is composed of a resin film and a metal layer.

8. The system as set forth in claim 1, wherein the second compliance component accounts for more than 45% of the compliance component.

9. The system as set forth in claim 1, wherein the at least one of the pressure generating chambers are partitioned into a plurality of chambers in a deforming direction of the electromechanical transducing element which are communicated with each other by a through hole.

10. The system as set forth in claim 1, wherein the first compliance component includes the partition walls and the vibrating plate.

11. An image recording apparatus comprising the system as set forth in any one of claims 1 to 10.

12. The system according to claim 1, wherein the first compliance component corresponds to a ratio of the change in volume of the at least one of the pressure generating chambers to the change in pressure of the at least one of the pressure generating chambers.

13. The system according to claim 1, wherein the second compliance component corresponds to a ratio of the volume of the at least one of the pressure generating chambers to an ink density.

14. A system containing an ink jet recording head and ink, the system comprising:

ink; and an ink jet recording head, including:

a channel forming substrate, formed with partition walls defining at least one pressure generating chamber therein;

at least one electromechanical transducing element, associated with each pressure generating chamber;

a nozzle plate, composing a part of an inner wall of the at least one pressure generating chamber, the nozzle plate formed with at least one nozzle orifice communicated with each associated pressure generating chamber; and a vibration plate, composing a part of an inner wall of the at least one pressure generating chamber for being flexed by deformation of the electromechanical transducing element to varying the volume of the associated pressure generating chamber, the vibration plate formed with a first portion having a first thickness and a second portion having a second thickness larger than the first thickness, wherein compliance components of the system comprise:

a first compliance component corresponding to the partition walls of the channel forming substrate, the nozzle plate and the vibration plate; and a second compliance component corresponding to the ink contained in the at least one pressure generating chamber, the second compliance component being larger than the first compliance component.

15. The system as set forth in claim 14, wherein the volume of the at least one of the pressure generating chambers is determined so as to increase the relative percentage of the second compliance component.

16. The system as set forth in claim 14, wherein a thickness of the channel forming substrate mainly determines the volume of the at least one of the pressure generating chambers is determined.

17. The system as set forth in claim 14, wherein a compliance component corresponding to the vibration plate is smaller than the second compliance component.

18. The system as set forth in claim 17, wherein the compliance component corresponding to the vibration plate is mainly determined by a thickness of the first portion of the vibration plate.

19. The system as set forth in claim 14, wherein the at least one of the electromechanical transducing element is a piezoelectric vibrator.

20. The system as set forth in claim 14, wherein the channel forming substrate is formed by anisotropically etching a silicon substrate.

21. The system as set forth in claim 14, wherein the vibration plate includes a first layer having the first thickness and a second layer laminated on the first layer so as to have the second thickness.

22. The system as set forth in claim 21, wherein:

the channel forming substrate is formed with partition walls defining therein a common ink reservoir which stores ink to be supplied to the respective pressure generating chambers; and the first layer extends so as to compose a part of an inner wall of the common ink reservoir.

23. The system as set forth in claim 21, wherein the first layer is a resin film and the second layer is a metal layer.

24. An ink jet recording apparatus comprising the system as set forth in any one of claims 14 to 23.

* * * * *